US010221525B2

(12) United States Patent
Harvey

(10) Patent No.: US 10,221,525 B2
(45) Date of Patent: Mar. 5, 2019

(54) SUCTION ROLL WITH PATTERN OF THROUGH HOLES AND BLIND DRILLED HOLES THAT IMPROVES LAND DISTANCE

(71) Applicant: Stowe Woodward Licensco, LLC, Raleigh, NC (US)

(72) Inventor: Glen A. Harvey, Baton Rouge, LA (US)

(73) Assignee: Stowe Woodward Licensco, LLC, Raleigh, NC (US)

( * ) Notice: Subject to any disclaimer, the term of this patent is extended or adjusted under 35 U.S.C. 154(b) by 57 days.

(21) Appl. No.: 15/497,266

(22) Filed: Apr. 26, 2017

(65) Prior Publication Data

US 2017/0306559 A1 Oct. 26, 2017

Related U.S. Application Data

(60) Provisional application No. 62/327,847, filed on Apr. 26, 2016.

(51) Int. Cl.
*D21F 3/10* (2006.01)

(52) U.S. Cl.
CPC ..... *D21F 3/105* (2013.01); *D21F 3/10* (2013.01)

(58) Field of Classification Search
USPC ..... 162/372
See application file for complete search history.

(56) References Cited

U.S. PATENT DOCUMENTS

| | | | |
|---|---|---|---|
| 2,815,907 | A | 12/1957 | McCormick |
| 3,308,476 | A | 3/1967 | Kleesattel |
| 3,562,883 | A | 2/1971 | Kobayashi |
| 3,665,650 | A | 5/1972 | Przygocki |

(Continued)

FOREIGN PATENT DOCUMENTS

| | | |
|---|---|---|
| DE | 863 133 | 1/1953 |
| DE | 199 20 133 | 11/2000 |

(Continued)

OTHER PUBLICATIONS

Notification of Transmittal of the International Search Report and the Written Opinion of the International Searching Authority, or the Declaration corresponding to International Application No. PCT/US2017/029507 dated Sep. 18, 2017.

(Continued)

*Primary Examiner* — Mark Halpern
(74) *Attorney, Agent, or Firm* — Myers Bigel, P.A.

(57) ABSTRACT

A cylindrical polymeric cover for an industrial roll includes a plurality of through holes and a plurality of blind drilled holes. The through holes and the blind drilled holes are arranged in a pattern in which:

(a) the through holes are arranged in rows that define an oblique angle relative to a plane that is perpendicular to a longitudinal axis of the cover;

(b) the through holes of one row are offset from the through holes of the adjacent row, with the offset between rows defining an angle of approximately 20-40 degrees;

(c) the blind drilled holes are arranged in rows located between the rows of through holes;

(d) the blind drilled holes of one row are offset slightly from the blind drilled holes of the adjacent row, with the offset between rows defining an angle similar to that defined by the through holes; and (e) each of the blind drilled holes is located at the substantial center of a triangle defined by the closest three through holes.

14 Claims, 1 Drawing Sheet

(56) References Cited

U.S. PATENT DOCUMENTS

| | | | |
|---|---|---|---|
| 3,962,911 | A | 6/1976 | Grenlund |
| 4,016,756 | A | 4/1977 | Kunkle |
| 4,233,011 | A | 11/1980 | Bolender et al. |
| 4,352,481 | A | 10/1982 | Forward |
| 4,366,025 | A | 12/1982 | Gordon, Jr. et al. |
| 4,445,349 | A | 5/1984 | Eibe |
| 4,498,383 | A | 2/1985 | Pav et al. |
| 4,509,237 | A | 4/1985 | Volz et al. |
| 4,729,153 | A | 3/1988 | Pav et al. |
| 4,871,908 | A | 10/1989 | Skuratovsky et al. |
| 4,898,012 | A | 2/1990 | Jones et al. |
| 4,903,517 | A | 2/1990 | Van Haag et al. |
| 4,910,985 | A | 3/1990 | Ballyns |
| 4,938,045 | A | 7/1990 | Rosenstock et al. |
| 5,048,353 | A | 9/1991 | Justus |
| 5,086,220 | A | 2/1992 | Berthold et al. |
| 5,379,652 | A | 1/1995 | Allonen |
| 5,383,371 | A | 1/1995 | Laitinen |
| 5,466,343 | A | 11/1995 | Kankaanpaa |
| 5,535,240 | A | 7/1996 | Carney et al. |
| 5,562,027 | A | 10/1996 | Moore |
| 5,592,875 | A | 1/1997 | Moschel |
| 5,684,871 | A | 11/1997 | Devon et al. |
| 5,684,912 | A | 11/1997 | Slaney et al. |
| 5,699,729 | A | 12/1997 | Moschel |
| 5,739,626 | A | 4/1998 | Kojima et al. |
| 5,848,097 | A | 12/1998 | Carney et al. |
| 5,874,723 | A | 2/1999 | Hasegawa et al. |
| 5,915,648 | A | 6/1999 | Madrzak et al. |
| 5,925,220 | A | 7/1999 | Hirsch et al. |
| 5,947,401 | A | 9/1999 | Niccum |
| 5,953,230 | A | 9/1999 | Moore |
| 6,006,100 | A | 12/1999 | Koenck et al. |
| 6,205,369 | B1 | 3/2001 | Moore |
| 6,284,103 | B1 | 9/2001 | Eng et al. |
| 6,328,681 | B1 | 12/2001 | Stephens |
| 6,341,522 | B1 | 1/2002 | Goss et al. |
| 6,354,013 | B1 | 3/2002 | Mucke et al. |
| 6,361,483 | B1 | 3/2002 | Kirchner |
| 6,375,602 | B1 | 4/2002 | Jones |
| 6,430,459 | B1 | 8/2002 | Moore |
| 6,441,904 | B1 | 8/2002 | Shakespeare |
| 6,568,285 | B1 | 5/2003 | Moore |
| 6,617,764 | B2 | 9/2003 | Sebastian et al. |
| 6,682,632 | B2 | 1/2004 | Nikulainen et al. |
| 6,752,908 | B2 | 6/2004 | Gustafson et al. |
| 6,874,232 | B2 | 4/2005 | Madden et al. |
| 6,892,563 | B2 | 5/2005 | Gustafson et al. |
| 6,910,376 | B2 | 6/2005 | Maenpaa |
| 6,981,935 | B2 | 1/2006 | Gustafson |
| 6,988,398 | B2 | 1/2006 | Saloniemi et al. |
| 7,185,537 | B2 | 3/2007 | Muhs |
| 7,225,688 | B2 | 6/2007 | Moore et al. |
| 7,392,715 | B2 | 7/2008 | Moore et al. |
| 7,572,214 | B2 | 8/2009 | Gustafson |
| 7,581,456 | B2 | 9/2009 | Moore et al. |
| 7,963,180 | B2 | 6/2011 | Moore et al. |
| 8,236,141 | B2 | 8/2012 | Pak |
| 8,236,414 | B2 | 8/2012 | Piluso et al. |
| 8,346,501 | B2 | 1/2013 | Pak |
| 8,474,333 | B2 | 7/2013 | Berendes et al. |
| 8,475,347 | B2 | 7/2013 | Gustafson et al. |
| 2003/0115947 | A1 | 6/2003 | Salonieme et al. |
| 2004/0053758 | A1 | 3/2004 | Gustafson |
| 2005/0000303 | A1 | 1/2005 | Moore et al. |
| 2005/0261115 | A1 | 11/2005 | Moore |
| 2006/0090574 | A1 | 5/2006 | Moore et al. |
| 2006/0248723 | A1 | 11/2006 | Gustafson |
| 2008/0264184 | A1 | 10/2008 | Moore et al. |
| 2009/0320612 | A1 | 12/2009 | Moore et al. |
| 2010/0324856 | A1 | 12/2010 | Pak |
| 2011/0226070 | A1 | 9/2011 | Berendes et al. |
| 2012/0310596 | A1 | 12/2012 | Gustafson et al. |
| 2014/0374460 | A1 | 12/2014 | Breineder et al. |

FOREIGN PATENT DOCUMENTS

| | | | |
|---|---|---|---|
| EP | 0 538 221 | A2 | 4/1993 |
| EP | 1 493 565 | A2 | 1/2005 |
| EP | 1 653 207 | A2 | 5/2006 |
| EP | 1 719 836 | A1 | 11/2006 |
| FR | 2 769 379 | | 4/1999 |
| JP | 2006164244 | A | 6/2006 |
| JP | 2009298265 | | 12/2009 |
| WO | WO 96/34262 | A1 | 10/1996 |
| WO | WO 01/53787 | A1 | 7/2001 |
| WO | WO 05/113891 | A1 | 12/2005 |
| WO | WO 2010/043433 | | 4/2010 |

OTHER PUBLICATIONS

International Search Report and Written Opinion for corresponding PCT Application No. PCT/US2015/048863, dated Mar. 3, 2016, 16 pages.

Preliminary Report of Issuance of Office Action for Japanese Patent Application No. 2011-125400, dated Dec. 21, 2012.

Examiner's Report for Canadian Application No: 2,741,931 dated Jul. 11, 2012.

Anonymous "Les capteurs à fibres optiques opérationnels?" *Mesures Regulation Automatisme*, FR, CFW, Paris, Oct. 20, 1986, pp. 49-51, 53, 55, vol. 51, No. 13 (XP002083807).

Bazergui, A., and M.L. Meyer, "Embedded Strain Gages for the Measurement of Strains in Rolling Contact," *Experimental Mechanics*, Oct. 1968, pp. 433-441.

Keller, S.F., "Measurement of the Pressure-Time Profile in a Rolling Calender Nip," 77$^{th}$ *Annual Meeting of the Canadian Section of the Pulp and Paper Assn.* 1991, pp. B89-B96.

Knowles, S.F., et al., "Multiple Microbending Optical-fibre Sensors for Measurement of Fuel Quantity in Aircraft Fuel Tanks," *Sensors and Actuators*, Jun. 15, 1998, pp. 320-323, vol. 68. No. 1-3 (XP004139852).

Koriseva, J., et al., "Soft Calendar Nip: An Interesting Subject for Research and Measurement," *Paper and Timber*, 1991, pp. 419-423, vol. 73, No. 5.

McCollum, T., and G. B. Spector, "Fiber Optic Microbend Sensor for Detection of Dynamic Fluid Pressure at Gear Interfaces," *Rev. Sci. Instrum.*, Mar. 1, 1994, pp. 724-729. vol. 65, No. 3 (XP000435198).

McNamee, J.P., "A Study of Rubber Covered Press Roll Nip Dynamics, Part 1," *The Journal of the Technical Association of the Pulp and Paper Industry*, Dec. 1965. pp. 673-679, vol. 48, No. 12.

Merriman, T.L., "Transducers and Techniques of Contact Pressure Measurement," Paper presented at *The Society for Experimental Mechanics, Spring Conference*, Jun. 1991, pp. 318-320.

Parish, G.J., "Measurements of Pressure Distribution Between Metal and Rubber Covered Rollers," *British Journal of Applied Physics*, Apr. 1959, pp. 158-161, vol. 9.

Spengos, A.C., "Experimental Investigation of Rolling Contact" *Journal of Applied Mechanics*, Dec. 1965, pp. 859-864.

International Search Report for PCT/US01/02013, dated May 22, 2001.

International Search Report for PCT/US03/18895 dated Sep. 30, 2003.

International Search Report for PCT/US2005/016456 dated Sep. 5, 2005.

International Search Report and Written Opinion for PCT/US2010/038581 dated Dec. 23, 2010.

European Search Report for EP 05 02 7237, dated Aug. 29, 2006.

The Extended European Search Report for European Patent Application No. 10166806.9-2314; dated Oct. 13, 2010.

International Preliminary Report on Patentability corresponding to international Application No. US/2017/029507 dated Nov. 8, 2018.

SUCTION ROLL WITH PATTERN OF THROUGH HOLES AND BLIND DRILLED HOLES THAT IMPROVES LAND DISTANCE

RELATED APPLICATION

The present application claims priority from and the benefit of U.S. Provisional Patent Application No. 62/327,847, filed Apr. 26, 2016, the disclosure of which is hereby incorporated herein in its entirety.

FIELD OF THE INVENTION

The present invention relates generally to industrial rolls, and more particularly to rolls for papermaking.

BACKGROUND OF THE INVENTION

Cylindrical rolls are utilized in a number of industrial applications, especially those relating to papermaking. Such rolls are typically employed in demanding environments in which they can be exposed to high dynamic loads and temperatures and aggressive or corrosive chemical agents. As an example, in a typical paper mill, rolls are used not only for transporting a fibrous web sheet between processing stations, but also, in the case of press section and calender rolls, for processing the web sheet itself into paper.

A papermaking machine may include one or more suction rolls placed at various positions within the machine to draw moisture from a belt (such as a press felt) and/or the fiber web. Each suction roll is typically constructed from a metallic shell covered by a polymeric cover with a plurality of holes extending radially therethrough. Vacuum pressure is applied with a suction box located in the interior of the suction roll shell. Water is drawn into the radially-extending holes and is either propelled centrifugally from the holes after they pass out of the suction zone or transported from the interior of the suction roll shell through appropriate fluid conduits or piping. The holes are typically formed in a grid-like pattern by a multi-bit drill that forms a line of multiple holes at once (for example, the drill may form fifty aligned holes at once). In many grid patterns, the holes are arranged such that rows and columns of holes are at an oblique angle to the longitudinal axis of the roll. Additional information regarding suction rolls is provided in U.S Patent Publication No. 2016/0076200, published Mar. 17, 2016, the disclosure of which is hereby incorporated herein in its entirety.

Also, in some suction rolls, blind drilled holes are included in the roll cover to assist with drainage. It may be desirable to provide a pattern of suction holes and blind drilled holes that improves performance of the roll cover.

SUMMARY

As a first aspect, embodiments of the invention are directed to an industrial roll, comprising: a substantially cylindrical shell having an outer surface and an internal lumen; and a polymeric cover circumferentially overlying the shell outer surface, wherein the shell and cover have a plurality of through holes that provide fluid communication between the lumen and the atmosphere, and the cover has a plurality of blind drilled holes. The through holes and the blind drilled holes are arranged in a pattern in which:

(a) the through holes are arranged in rows that define an oblique angle relative to a plane that is perpendicular to a longitudinal axis of the roll;

(b) the through holes of one row are offset from the through holes of the adjacent row, with the offset between rows defining an angle of approximately 20-40 degrees;

(c) the blind drilled holes are arranged in rows located between the rows of through holes;

(d) the blind drilled holes of one row are offset slightly from the blind drilled holes of the adjacent row, with the offset between rows defining an angle similar to that defined by the through holes; and (e) each of the blind drilled holes is located at the substantial center of a triangle defined by the closest three through holes.

As a second aspect, embodiments of the invention are directed to a cylindrical polymeric cover for an industrial roll, the cover including a plurality of through holes and a plurality of blind drilled holes. The through holes and the blind drilled holes are arranged in a pattern in which:

(a) the through holes are arranged in rows that define an oblique angle relative to a plane that is perpendicular to a longitudinal axis of the cover;

(b) the through holes of one row are offset from the through holes of the adjacent row, with the offset between rows defining an angle of approximately 20-40 degrees;

(c) the blind drilled holes are arranged in rows located between the rows of through holes;

(d) the blind drilled holes of one row are offset slightly from the blind drilled holes of the adjacent row, with the offset between rows defining an angle similar to that defined by the through holes; and (e) each of the blind drilled holes is located at the substantial center of a triangle defined by the closest three through holes.

As a third aspect, embodiments of the invention are directed to an industrial roll, comprising: a substantially cylindrical shell having an outer surface and an internal lumen; and a polymeric cover circumferentially overlying the shell outer surface. The shell and cover have a plurality of through holes that provide fluid communication between the lumen and the atmosphere, and the cover has a plurality of blind drilled holes. The through holes and the blind drilled holes are arranged in a pattern in which:

(a) the through holes are arranged in rows that define an oblique angle relative to a plane that is perpendicular to a longitudinal axis of the roll;

(b) the through holes of one row are offset from the through holes of the adjacent row;

(c) the blind drilled holes are arranged in rows located between the rows of through holes;

(d) the blind drilled holes of one row are offset slightly from the blind drilled holes of the adjacent row, with the offset between rows defining an angle similar to that defined by the through holes; and (e) each of the blind drilled holes is located at the substantial center of a triangle defined by the closest three through holes.

DETAILED DESCRIPTION

Figure 1:
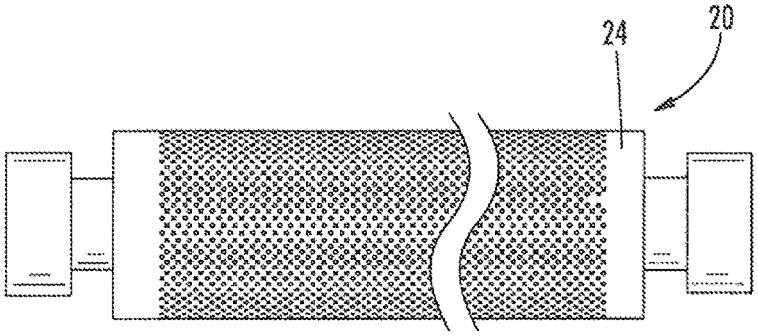
FIG. 1 is a gage view of a suction roll with a cover according to embodiments of the present invention.

The present invention will be described more particularly hereinafter with reference to the accompanying drawings.

The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items. Where used, the terms "attached", "connected", "interconnected", "contacting", "coupled", "mounted" and the like can mean either direct or indirect attachment or contact between elements, unless stated otherwise.

Referring now to the figures, a suction roll, designated broadly at 20, is illustrated in FIG. 1. The suction roll 20 includes a hollow cylindrical shell or core 22 and a cover 24 (typically formed of one or more polymeric materials) that encircles the shell 22. The shell 22 (seen in FIG. 2) is typically formed of a corrosion-resistant metallic material, such as stainless steel or bronze. A suction box (not shown) is typically positioned within the lumen of the shell 22 to apply negative pressure (i.e., suction) through holes in the shell 22 and cover 24. Typically, the shell 22 will already include through holes that will later align with through holes 82 in the cover 24. An exemplary shell and suction box combination is illustrated and described in U.S. Pat. No. 6,358,370 to Huttunen, the disclosure of which is hereby incorporated herein in its entirety.

Figure 2:
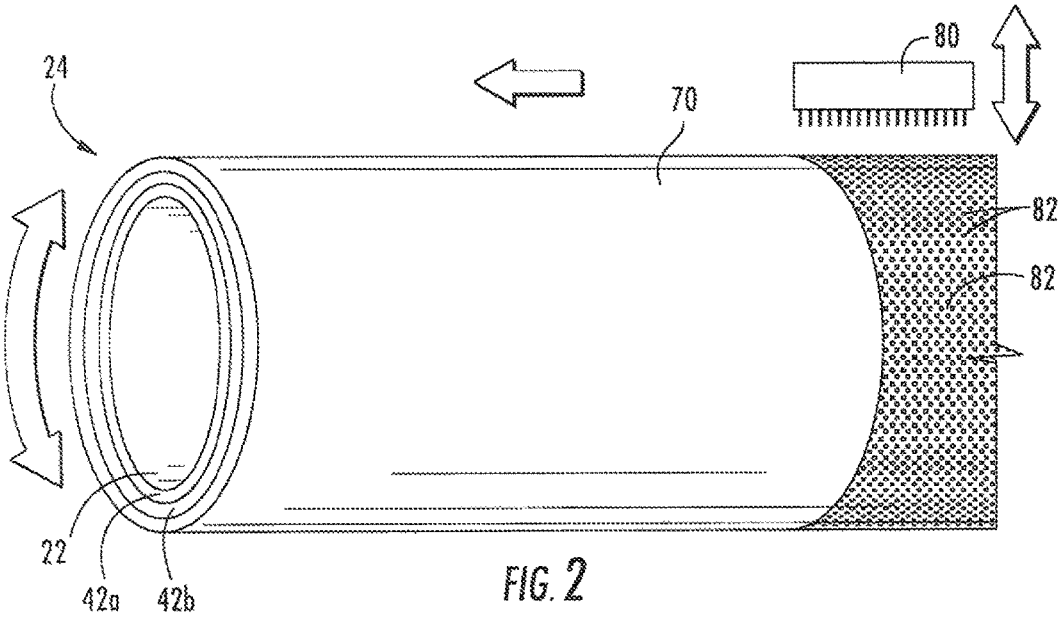
FIG. 2 is a gage perspective view of the roll and roll cover of FIG. 1 being drilled with a drill.

The cover 24 can take any form and can be formed of any polymeric and/or elastomeric material recognized by those skilled in this art to be suitable for use with a suction roll. Exemplary materials include natural rubber, synthetic rubbers such as neoprene, styrene-butadiene (SBR), nitrile rubber, chlorosulfonated polyethylene ("CSPE"—also known under the trade name HYPALON), EDPM (the name given to an ethylene-propylene terpolymer formed of ethylene-propylene diene monomer), epoxy, and polyurethane. In many instances, the cover 24 will comprise multiple layers. FIG. 2 illustrates that an inner base layer 42*a*, an outer base layer 42*b* and a topstock layer 70 are applied; additional layers, such as a "tie-in" layer between the base and topstock layers 42*a*, 42*b*, 70 and an adhesive layer between the shell 22 and the inner base layer 42, may also be included. The cover 24 may also include reinforcing and filler materials, additives, and the like. Exemplary additional materials are discussed in U.S. Pat. No. 6,328,681 to Stephens, U.S. Pat. No. 6,375,602 to Jones and U.S. Pat. No. 6,981,935 to Gustafson, the disclosures of each of which are hereby incorporated herein in their entireties.

Figure 3:
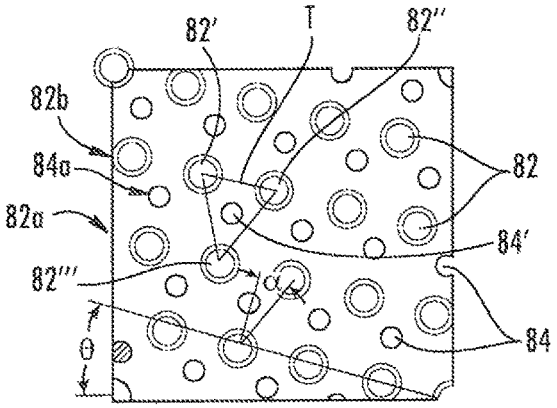
FIG. 3 is a greatly enlarged view of the suction hole and blind drilled hole pattern of the roll cover of FIG. 1.

The cover 24 has a pattern of holes includes through holes 82 and blind drilled holes 84. As can be seen in FIG. 3, the pattern of holes is one in which:

(a) the through holes 82 are arranged in rows that define an oblique angle θ (typically between about 5 and 20 degrees) relative to a plane that is perpendicular to the longitudinal axis of the roll 20;

(b) the through holes 82*a* of one row are offset from the through holes 82*b* of the adjacent row, with the offset between rows defining an angle α of approximately 20-40 degrees;

(c) the blind drilled holes 84 are arranged in rows located between the rows of through holes 82;

(d) the blind drilled holes 84*a* of one row are offset slightly from the blind drilled holes of the adjacent row, with the offset between rows defining an angle similar to that defined by the through holes 82; and (e) each of the blind drilled holes 84 is located at the center of a triangle T defined by the closest three through holes 82 (e.g., the blind drilled hole 84' is located at the center of the triangle defined by through holes 82', 82" of row of through holes 82*b* and through hole 82''' of row of through holes 82*a*). This positioning causes the spacing of each row of blind drilled holes 84 from its adjacent rows of through holes 82 to differ. In one embodiment, a row of blind drilled holes 84 (e.g., row 84*a*) is between about 1.8 to 2.2 times farther from one adjacent row of through holes 82 (e.g., row 82*a*) as from its other adjacent row of through holes 82 (e.g., row 82*b*) with the positions of the rows measured from lines through the hole centers.

In this pattern, advantages over prior patterns can be realized. The sizes of both the through holes 82 and the blind drilled holes 84 can be increased compared to prior designs. The land distance between holes 82, 84 is typically a limiting factor in hole pattern design, with a minimum land distance required for a given roll and roll cover. With this pattern, the minimum land distance between a blind drilled hole 84 and the three surrounding through holes 82 can be met comfortably, and can enable larger through holes 82 and/or blind drilled holes 84 to be used. In turn, the use of larger holes 82, 84 can increase the open area of the roll cover 24, which can improve performance. Additionally, the use of larger holes 82, 84 can render the cover 24 less likely to suffer from plugging of the holes 82, 84, which can be a performance issue with suction rolls.

The cover for the suction roll 20 can be processed in any number of ways. After the top stock layer 70 is cured, the through holes 82 and the blind drilled holes 84 are formed in the cover 24 and, in the event that through holes 82 have not already been formed in the shell 22, are also formed therein. The through holes 82 and blind drilled holes 84 can be formed by any technique known to those skilled in this art, but are preferably formed with a multi-bit drill 80 as shown in FIG. 2 (an exemplary drill is the DRILLMATIC machine, available from Safop, Pordenone, Italy).

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An industrial roll, comprising:

a substantially cylindrical shell having an outer surface and an internal lumen;

a polymeric cover circumferentially overlying the shell outer surface, wherein the shell and cover have a plurality of through holes that provide fluid communication between the lumen and the atmosphere, and the cover has a plurality of blind drilled holes;

wherein the through holes and the blind drilled holes are arranged in a pattern in which:

(a) the through holes are arranged in rows that define an oblique angle relative to a plane that is perpendicular to a longitudinal axis of the roll;

(b) the through holes of one row are offset from the through holes of the adjacent row, with the offset between rows defining an angle of approximately 20-40 degrees;

(c) the blind drilled holes are arranged in rows located between the rows of through holes;

(d) the blind drilled holes of one row are offset slightly from the blind drilled holes of the adjacent row, with the offset between rows defining an angle similar to that defined by the through holes; and (e) each of the blind drilled holes is located at the substantial center of a triangle defined by the closest three through holes.

2. The industrial roll defined in claim 1, wherein each of the blind drilled holes is nearer to a first adjacent row of through holes than to a second adjacent row of through holes.

3. The industrial roll defined in claim 2, wherein each of the blind drilled holes is between 1.8 and 2.2 times nearer to the first adjacent row of through holes than to the second adjacent row of through holes.

4. The industrial roll defined in claim 1, wherein the industrial roll is a suction roll of a papermaking machine.

5. The industrial roll defined in claim 1, wherein the oblique angle defined by the through holes is between about 5 and 20 degrees.

6. A cylindrical polymeric cover for an industrial roll, the cover including a plurality of through holes and a plurality of blind drilled holes, wherein the through holes and the blind drilled holes are arranged in a pattern in which:

(a) the through holes are arranged in rows that define an oblique angle relative to a plane that is perpendicular to a longitudinal axis of the cover;

(b) the through holes of one row are offset from the through holes of the adjacent row, with the offset between rows defining an angle of approximately 20-40 degrees;

(c) the blind drilled holes are arranged in rows located between the rows of through holes;

(d) the blind drilled holes of one row are offset slightly from the blind drilled holes of the adjacent row, with the offset between rows defining an angle similar to that defined by the through holes; and (e) each of the blind drilled holes is located at the substantial center of a triangle defined by the closest three through holes.

7. The polymeric cover defined in claim 6, wherein each of the blind drilled holes is nearer to a first adjacent row of through holes than to a second adjacent row of through holes.

8. The polymeric cover defined in claim 7, wherein each of the blind drilled holes is between 1.8 and 2.2 times nearer to the first adjacent row than to a second adjacent row of through holes.

9. The polymeric cover defined in claim 6, wherein the oblique angle defined by the through holes is between about 5 and 20 degrees.

10. An industrial roll, comprising:

a substantially cylindrical shell having an outer surface and an internal lumen;

a polymeric cover circumferentially overlying the shell outer surface, wherein the shell and cover have a plurality of through holes that provide fluid communication between the lumen and the atmosphere, and the cover has a plurality of blind drilled holes;

wherein the through holes and the blind drilled holes are arranged in a pattern in which:

(a) the through holes are arranged in rows that define an oblique angle relative to a plane that is perpendicular to a longitudinal axis of the roll;

(b) the through holes of one row are offset from the through holes of the adjacent row;

(c) the blind drilled holes are arranged in rows located between the rows of through holes;

(d) the blind drilled holes of one row are offset slightly from the blind drilled holes of the adjacent row, with the offset between rows defining an angle similar to that defined by the through holes; and (e) each of the blind drilled holes is located at the substantial center of a triangle defined by the closest three through holes.

11. The industrial roll defined in claim 10, wherein each of the blind drilled holes is nearer to a first adjacent row of through holes than to a second adjacent row of through holes.

12. The industrial roll defined in claim 1, wherein each of the blind drilled holes is between 1.8 and 2.2 times nearer to the first adjacent row of through holes than to the second adjacent row of through holes.

13. The industrial roll defined in claim 10, wherein the industrial roll is a suction roll of a papermaking machine.

14. The industrial roll defined in claim 10, wherein the oblique angle defined by the through holes is between about 5 and 20 degrees.

* * * * *